US010254040B2

(12) United States Patent
Rauch et al.

(10) Patent No.: US 10,254,040 B2
(45) Date of Patent: Apr. 9, 2019

(54) AIR SEPARATION SYSTEM AND METHOD

(71) Applicants: Jeremiah J. Rauch, Clarence, NY (US); Sophia J. Dowd, Grand Island, NY (US); Andrew M. Warta, Wheatfield, NY (US); Catherine B. Sarigiannis, Grand Island, NY (US); Wei Zhang, Mississauga (CA)

(72) Inventors: Jeremiah J. Rauch, Clarence, NY (US); Sophia J. Dowd, Grand Island, NY (US); Andrew M. Warta, Wheatfield, NY (US); Catherine B. Sarigiannis, Grand Island, NY (US); Wei Zhang, Mississauga (CA)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 316 days.

(21) Appl. No.: 15/399,297

(22) Filed: Jan. 5, 2017

(65) Prior Publication Data

US 2017/0115053 A1 Apr. 27, 2017

Related U.S. Application Data

(62) Division of application No. 14/293,003, filed on Jun. 2, 2014, now Pat. No. 9,574,821.

(51) Int. Cl.

| | |
|---|---|
| ***F25J 1/00*** | (2006.01) |
| ***F25J 3/04*** | (2006.01) |
| ***F25J 3/08*** | (2006.01) |

(52) U.S. Cl.

CPC ..... *F25J 3/04024* (2013.01); *F25J 1/0012* (2013.01); *F25J 3/0409* (2013.01); (Continued)

(58) Field of Classification Search

CPC .... F25J 1/0012; F25J 3/04812; F25J 3/04024; F25J 3/04084; F25J 3/0409; (Continued)

(56) References Cited

U.S. PATENT DOCUMENTS

| | | | |
|---|---|---|---|
| 3,477,239 | A | 11/1969 | Rische |
| 4,861,351 | A | 8/1989 | Nicholas et al. |

(Continued)

FOREIGN PATENT DOCUMENTS

| | | |
|---|---|---|
| CN | 102192637 | 9/2011 |
| EP | 0 880 000 A2 | 11/1998 |

(Continued)

*Primary Examiner* — Elizabeth J Martin
(74) *Attorney, Agent, or Firm* — Robert J. Hampsch

(57) ABSTRACT

A system and method for separating air in an air separation plant is provided. The disclosed systems and methods divert a portion of the compressed, purified air stream to a bypass system configured to selectively produce a higher pressure compressed output stream or a lower pressure compressed output stream. The higher pressure and/or lower pressure compressed output streams are cooled in a main heat exchanger by indirect heat transfer with a plurality of product streams from the air separation plant and then rectified in the distillation column system. A second portion of the compressed, purified air stream is partially cooled in the main heat exchanger and expanding in a turbo-expander to produce power and an exhaust stream which is directed to the distillation column system of the air separation plant where it imparts additional refrigeration generated by the expansion of the compressed air stream in the turbo-expander.

7 Claims, 2 Drawing Sheets

(52) U.S. Cl.
CPC ..... *F25J 3/04084* (2013.01); *F25J 3/04175* (2013.01); *F25J 3/04218* (2013.01); *F25J 3/04296* (2013.01); *F25J 3/04303* (2013.01); *F25J 3/04393* (2013.01); *F25J 3/04412* (2013.01); *F25J 3/04781* (2013.01); *F25J 3/04812* (2013.01); *F25J 3/08* (2013.01); *F25J 2210/40* (2013.01); *F25J 2215/54* (2013.01); *F25J 2220/40* (2013.01); *F25J 2230/30* (2013.01); *F25J 2230/40* (2013.01); *F25J 2240/46* (2013.01); *F25J 2245/40* (2013.01)

(58) Field of Classification Search
CPC .. F25J 3/04175; F25J 3/04218; F25J 3/04296; F25J 3/04303; F25J 3/04393; F25J 3/04412; F25J 3/04781; F25J 2245/40
See application file for complete search history.

(56) References Cited

U.S. PATENT DOCUMENTS

| | | | |
|---|---|---|---|
| 5,901,579 | A | 5/1999 | Mahoney et al. |
| 9,279,613 | B2 | 3/2016 | Howard |
| 9,441,878 | B2 | 9/2016 | Howard |
| 2009/0241595 | A1 | 10/2009 | Chinta et al. |
| 2012/0131951 | A1 | 5/2012 | Myobatake et al. |
| 2013/0170952 | A1 | 7/2013 | Brenne et al. |
| 2014/0230430 | A1 | 8/2014 | Krug et al. |

FOREIGN PATENT DOCUMENTS

| | | | |
|---|---|---|---|
| EP | 1 186 844 | A2 | 3/2002 |
| EP | 1 586 838 | A1 | 10/2005 |
| JP | H 02275282 | A | 11/1990 |
| WO | WO 2008/070757 | A1 | 6/2008 |

AIR SEPARATION SYSTEM AND METHOD

CROSS REFERENCE TO RELATED APPLICATIONS

The present application is a divisional application that claims the benefit of and priority to U.S. patent application Ser. No. 14/293,003filed on Jun. 2, 2014.

FIELD OF THE INVENTION

The present invention relates to an air separation method and apparatus in which refrigeration is imparted to an air separation plant by forming a compressed air stream from compressed and purified air, expanding the compressed air stream in a turbo-expander to produce an exhaust stream and introducing the exhaust stream into a distillation column system that produces one or more liquid products. More particularly, the present invention relates to such a method and apparatus in which the compressed air stream is further compressed by a booster compressor prior to expansion to increase the refrigeration and production of the liquid products or bypasses the booster compressor to decrease the refrigeration and production of the liquid products.

BACKGROUND

Air is separated in air separation plants that employ cryogenic rectification to separate the air into products that include nitrogen, oxygen and argon. In such plants, the air is compressed, purified of higher boiling contaminants such as carbon dioxide and water, cooled to a temperature suitable for the distillation of the air and then introduced into a distillation column system.

In one typical distillation column system, the air is separated in a higher pressure column into a nitrogen-rich vapor column overhead and a crude liquid oxygen column bottoms, also known as kettle liquid. A stream of the crude liquid oxygen column bottoms is introduced into a lower pressure column for further refinement into an oxygen-rich liquid column bottoms and a nitrogen-rich vapor column overhead. The lower pressure column operates at a lower pressure than the higher pressure column and is thermally linked to the higher pressure column by a heat exchanger known as a condenser reboiler. The condenser reboiler condenses a stream of the of the nitrogen-rich vapor column overhead through indirect heat exchange with the oxygen-rich liquid column bottoms to produce liquid nitrogen reflux for both the higher and lower pressure columns and to create boilup in the lower pressure column by vaporization of part of the oxygen-rich liquid column bottoms produced in such column.

In any type of air separation plant, liquid and vapor that can be composed of nitrogen-rich and oxygen-rich liquid and vapor are introduced into a main heat exchanger and passed in indirect heat exchange with the incoming air to help cool the air and to be taken as products from the warm end of the main heat exchanger. In addition, liquid products enriched in oxygen, nitrogen or both can be taken from the distillation column system as liquid products. Also, all or a portion of liquid streams removed from columns can be pumped to produce a pumped or pressurized liquid which is heated in the main heat exchanger or a separate heat exchanger designed to operate at high pressure and produce a enriched products as either a vapor or a supercritical fluid.

Since an air separation plant must be maintained at cryogenic temperatures in order to allow the air to be distilled, refrigeration must be imparted to the plant in order to compensate for heat leakage into the plant and warm end losses from the main heat exchanger or other heat exchanger operated in association therewith. Further, the removal of liquid products will also remove imparted refrigeration that must also be compensated through introduction of refrigeration into the plant. This is commonly done by forming a compressed air stream by introducing the compressed and purified air into a booster compressor. The compressed air stream after such further compression is then introduced, either directly or after partially cooling such stream, into a turbo-expander to produce an exhaust stream that is introduced into the distillation column system. In this regard, such exhaust stream can be introduced into the lower pressure column or the higher pressure column.

In large part, the ongoing expense in operating an air separation plant is the cost of electricity that is consumed in compressing the air. As mentioned above, when liquid is to be taken as a product, further compression will be required to generate the refrigeration that will be required when such liquid products are produced. However, the demand for liquid products and the cost of electricity are not constant. For instance, the cost of electricity and the liquid demand will often be less during evening hours as compared with daylight electricity costs and liquid demands. Consequently, air separation plants can be designed to cyclically produce a greater share of liquid products or higher pressure products when electricity is less expensive.

Many air separation plants also have a need to vary the pressure of the gaseous and liquid products produced. Examples may include an air separation plant that feeds multiple pipelines or dual air separation plant that is specifically designed having dual cores or dual cold boxes to produce products at different pressures. In such situations, there is occasionally the need to alter the product mix requiring a switch or reallocation to or from the higher pressure product or higher pressure pipeline. Yet another common scenario is a dual or single pressure air separation plant that selectively modifies the product slate to produce more argon or low pressure nitrogen when electricity is less expensive in lieu of high pressure or medium pressure oxygen.

The conventional solution or technique used to achieve this variation in product pressures is to adjust the compressor guide vanes to reduce BAC pressure. However, when lowering the product pressures, the conventional solution of varying the compressor guide vanes to reduce BAC pressure often leads to little or no power savings and thus no significant cost reductions. As will be discussed, the present invention provides a method of separating air and an air separation plant which among other advantages, allows a booster compressor to by bypassed to turn down or turn up the pressurized product pressures and/or production rates with greater efficiencies and cost savings than are contemplated in the prior art.

SUMMARY OF THE INVENTION

The present invention may be characterized as a method of separating air in an air separation plant comprising: (i) separating compressed, purified air within the air separation plant to produce a plurality of product streams, including one or more pressurized products by heating one or more pressurized liquid streams enriched in a component of the compressed, purified air; (ii) varying a flow rate of the one or more pressurized liquid streams or a pressure of the one or more pressurized liquid streams to in turn vary a production rates or a pressures of the pressurized products; (iii) diverting a portion of the compressed, purified air to a bypass system to produce a compressed output stream; (iv) selectively introducing the portion of the compressed, purified air into a booster compressor circuit of the bypass system to further compress the compressed, purified air and thereby produce the compressed output stream at a higher pressure when the flow rate or the pressure of the pressurized liquid stream is increased or a bypass circuit of the bypass system to produce the compressed output stream at a lower pressure when the flow rate or the pressure of the pressurized liquid stream is reduced; and (v) passing the compressed output stream in indirect heat exchange with the pressurized liquid streams to produce the one or more pressurized products.

The present invention may also be characterized as an air separation system comprising: (a) an air intake system comprising a main air compressor, a purification unit connected to the main air compressor, the air intake system configured to produce a stream of compressed, purified air; (b) the bypass system comprising a booster compressor circuit, one or more compressors, a bypass circuit and a plurality of control valves to control the flows through the booster compressor circuit and the bypass circuit configured to receive a first portion of the compressed, purified air stream and condition it into a compressed output stream; (c) a main heat exchanger in flow communication with the air intake system and the bypass system, the main heat exchanger system configured to receive the conditioned compressed output stream and to receive a second portion of the compressed, purified air stream from the air intake system and to cool the respective streams; (d) a distillation column system comprising a higher pressure column and a lower pressure column connected to the main heat exchanger and configured to rectify the cooled, compressed output stream and thereby to produce a slate of products; (e) a turbo-expander in flow communication with the main heat exchanger and configured to receive and expand the cooled second portion of the compressed, purified air stream to produce power and an exhaust stream, wherein the exhaust stream is introduced into the distillation column system to impart supplemental refrigeration to the air separation plant; and (f) a control system operatively coupled to at least the bypass system to control the plurality of control valves to selectively introduce the first portion of the compressed, purified air stream into either the booster compressor circuit and thereby produce a higher pressure compressed output stream or into the bypass circuit to produce a lower pressure compressed output stream. The bypass system is further configured to prevent the booster compressors from surge conditions during production of the compressed output stream and to maintain a purge stream in the booster compressor circuit during production of the lower pressure compressed output stream.

Some embodiments of the disclosed system and method are configured to gradually divert the portion of the compressed air stream from the bypass circuit to the booster compressor circuit when shifting from production of the lower pressure compressed output stream to production of the higher pressure compressed output stream. Similarly, the disclosed system or methods would also gradually divert the portion of the compressed air stream from the booster compressor circuit to the bypass circuit when shifting from production of the higher pressure compressed output stream to production of the lower pressure compressed output stream.

The disclosed systems and methods may also circulate a recycle stream and/or a purge stream within the booster compressor circuit when the booster compressors are deactivated. The recycle stream generally flows from an outlet of a compressor in the booster compressor circuit to an inlet of a compressor in the booster compressor circuit. The purge stream may be a purified, low pressure gas supplied via a low pressure gas supply conduit to one or more of the compressors in the booster compressor circuit and vented via a vent conduit when the one or more of the compressors in the booster compressor circuit are deactivated. Use of the purge stream prevents ambient air from entering the booster compressors in the booster compressor circuit.

In some embodiments of the invention, a second portion of the compressed, purified air is diverted to the warm end of a main heat exchanger in the air separation plant. This second portion of the compressed, purified air may be cooled or partially cooled to an intermediate temperature, between temperatures of a warm end of the main heat exchanger and a cold end of the main heat exchanger. The cooled, second portion of the compressed, purified air is then expanded in a turbo-expander to produce power and an exhaust stream. Refrigeration generated by the expansion of the cooled, second portion of the compressed, purified air in the turbo-expander is preferably imparted to the distillation column system of the air separation plant, and more particularly to the higher pressure distillation column and/or the lower pressure distillation column.

The present invention may also be characterized as a method of producing dual pressurized oxygen products in an air separation plant comprising: (i) diverting compressed, purified air stream to a bypass system to produce one or more compressed output streams; (ii) separating a portion of the one or more compressed output streams within a first distillation column system of the air separation plant to produce plurality of product streams, including a first pressurized liquid oxygen stream at a high pressure; (iii) heating the first pressurized liquid oxygen stream in a first main heat exchanger via indirect heat exchange with the one or more compressed output streams to produce a first pressurized oxygen product stream; (iv) separating a portion of the one or more compressed output streams within a second distillation column system of the air separation plant to produce plurality of product streams, including a second pressurized liquid oxygen stream at a moderate or low pressure; (v) heating the second pressurized liquid oxygen stream in a second main heat exchanger via indirect heat exchange with the one or more compressed output streams to produce a second pressurized oxygen product stream; (vi) varying the pressure or flow rate of the first or second pressurized liquid oxygen streams to in turn vary the pressures or flow rates of the first or second pressurized oxygen product stream, respectively; (vii) reducing the pressure or flow rate of the first pressurized liquid oxygen stream to in turn reduce the pressure or flow rate of the first pressurized oxygen product stream to approach or match the pressure of the second pressurized oxygen product stream when increase in production of the pressurized oxygen product stream at the moderate or low pressure is desired and wherein a portion of the compressed, purified air in the bypass system is selectively introduced into a bypass circuit to produce the one or more compressed output streams at a lower pressure; and (viii) increasing the pressure or flow rate of the second pressurized liquid oxygen stream to in turn increase the pressure or flow rate of the second pressurized oxygen product stream to approach or match the pressure of the first pressurized oxygen product stream when increase in production of the pressurized oxygen product stream at the higher low pressure is desired and wherein a portion of the compressed, purified air in the bypass system is selectively introduced into a booster compressor circuit to produce the one or more compressed output streams at a higher pressure.

Another application of the present invention is as a method of producing dual pressurized oxygen products in an air separation plant comprising: (i) diverting part of a compressed, purified air stream to a bypass system to produce a compressed output stream; (ii) separating the compressed output stream within a distillation column system of the air separation plant to produce plurality of product streams, including at least one pressurized liquid oxygen streams; (iii) heating the at least one pressurized liquid oxygen streams in a main heat exchanger via indirect heat exchange with the compressed output stream to produce a first pressurized oxygen product stream at a high pressure and a second pressurized oxygen product stream at a low or moderate pressure; and (iv) varying the pressure or flow rate of the at least one pressurized liquid oxygen streams to in turn vary the pressures or flow rates of the first or second pressurized oxygen product streams. A portion of the compressed, purified air in the bypass system is selectively introduced into a booster compressor circuit to further compress the compressed, purified air and thereby produce the compressed output stream at a higher pressure when the pressure or flow rate of the first or second pressurized oxygen product streams is increased. Similarly, a portion of the compressed, purified air in the bypass system is selectively introduced into a bypass circuit to produce the compressed output stream at a lower pressure when the pressure or the flow rate of the first or second pressurized oxygen product streams is reduced. Such application of the present invention in the dual pressurized product type air separation plant is particularly beneficial when there is a need to transition from a high pressure oxygen product to a moderate or low pressure oxygen product or vice versa. The present method is also useful when adjusting the split or ratio between the dual pressurized products.

Yet another application of the present invention is as a method of producing a pressurized oxygen product stream in an air separation plant comprising: (i) diverting part of a compressed, purified air stream to a bypass system to produce a compressed output stream; (ii) separating the compressed output stream within a distillation column system of the air separation plant to produce plurality of product streams, including one or more pressurized liquid oxygen streams, and optionally a nitrogen product stream or an argon product stream; (iii) heating the one or more pressurized liquid oxygen streams in a main heat exchanger via indirect heat exchange with the compressed output stream to produce the pressurized oxygen product stream; (iv) reducing the pressure or flow rate of the one or more pressurized liquid oxygen streams to in turn reduce the pressure or flow rate of the pressurized oxygen product stream when production of the nitrogen product stream or argon product stream is increased and wherein a portion of the compressed, purified air in the bypass system is selectively introduced into a bypass circuit to produce the compressed output stream at a lower pressure when production of the nitrogen product stream or argon product stream is increased; and (v) increasing the pressure or flow rate of the one or more pressurized liquid oxygen streams to in turn increase the pressure or flow rate of the pressurized oxygen product streams when production of the nitrogen product stream or argon product stream is reduced and wherein a portion of the compressed, purified air in the bypass system is selectively introduced into a booster compression circuit to produce the compressed output stream at a higher pressure; when production of the nitrogen product stream or argon product stream is reduced. Such application of the present invention is particularly beneficial in operational settings when there is a need for increased argon recovery or nitrogen recovery in either a single pressurized product plant or a dual pressurized product plant. In dual pressurized product plants, the reduction or turn down of oxygen pressurized products in favor of increased argon recovery or nitrogen recovery can be directed to either the higher pressure oxygen product stream transitioning to a moderate pressure stream or can be directed to the lower pressure oxygen product stream.

A still further application of the present invention is as a method of upgrading production of a pressurized oxygen product in an air separation plant comprising: (i) diverting part of a compressed, purified air stream to a bypass system to produce a compressed output stream; (ii) separating the compressed output stream within a distillation column system of the air separation plant to produce plurality of product streams, including a pressurized liquid oxygen stream; (iii) heating the pressurized liquid oxygen stream in a main heat exchanger via indirect heat exchange with the compressed output stream to produce a pressurized oxygen product stream; (iv) varying the pressure or flow rate of the pressurized liquid oxygen stream to in turn vary the pressures or flow rates of the pressurized oxygen product stream; and (v) upgrading production of a pressurized oxygen product in an air separation plant by either increasing the pressure or flow rate of the pressurized liquid oxygen stream to in turn increase the pressure or flow rate of the pressurized oxygen product stream by diverting a portion of the compressed, purified air in the bypass system into a booster compression circuit to produce the compressed output stream at a higher pressure to produce a higher pressure pressurized oxygen product stream; or by reducing the pressure or flow rate of the pressurized liquid oxygen stream to in turn reduce the pressure or flow rate of the pressurized oxygen product stream by diverting a portion of the compressed, purified air in the bypass system into a bypass circuit to produce the compressed output stream at a lower pressure to produce a lower pressure pressurized oxygen product stream.

Finally, a still further application of the present invention is as a method of adjusting the split in production of two or more pressurized oxygen products in an air separation plant comprising: (i) diverting part of a compressed, purified air stream to a bypass system to produce a compressed output stream; (ii) separating the compressed output stream within a distillation column system of the air separation plant to produce plurality of product streams, including the two or more pressurized liquid oxygen streams; (iii) heating the pressurized liquid oxygen streams in a main heat exchanger via indirect heat exchange with the compressed output stream to produce a first pressurized oxygen product stream at a high pressure and a second pressurized oxygen product stream at a low or moderate pressure; (iv) varying the pressure or flow rate of the at least one pressurized liquid oxygen streams to in turn vary the pressures or flow rates of the first or second pressurized oxygen product streams; and (v) adjusting the split in production between the first pressurized oxygen product stream and the second pressurized oxygen product stream by diverting a portion of the compressed, purified air in the bypass system into a booster compressor circuit and thereby produce the compressed output stream at a higher pressure when the flow rate of the first pressurized oxygen product stream is increased and diverting a portion of the compressed, purified air in the bypass system into a bypass circuit and thereby produce the compressed output stream at a lower pressure when the flow rate of the first pressurized oxygen product streams is reduced.

BRIEF DESCRIPTION OF THE DRAWINGS

While the specification concludes with claims distinctly pointing out the subject matter that Applicants regard as their invention, it is believed that the invention and its advantages will be better understood when taken in connection with the accompanying drawings in which:

In the drawings, identical or nearly identical components that are illustrated in various figures are represented by like numerals.

DETAILED DESCRIPTION

Figure 1:
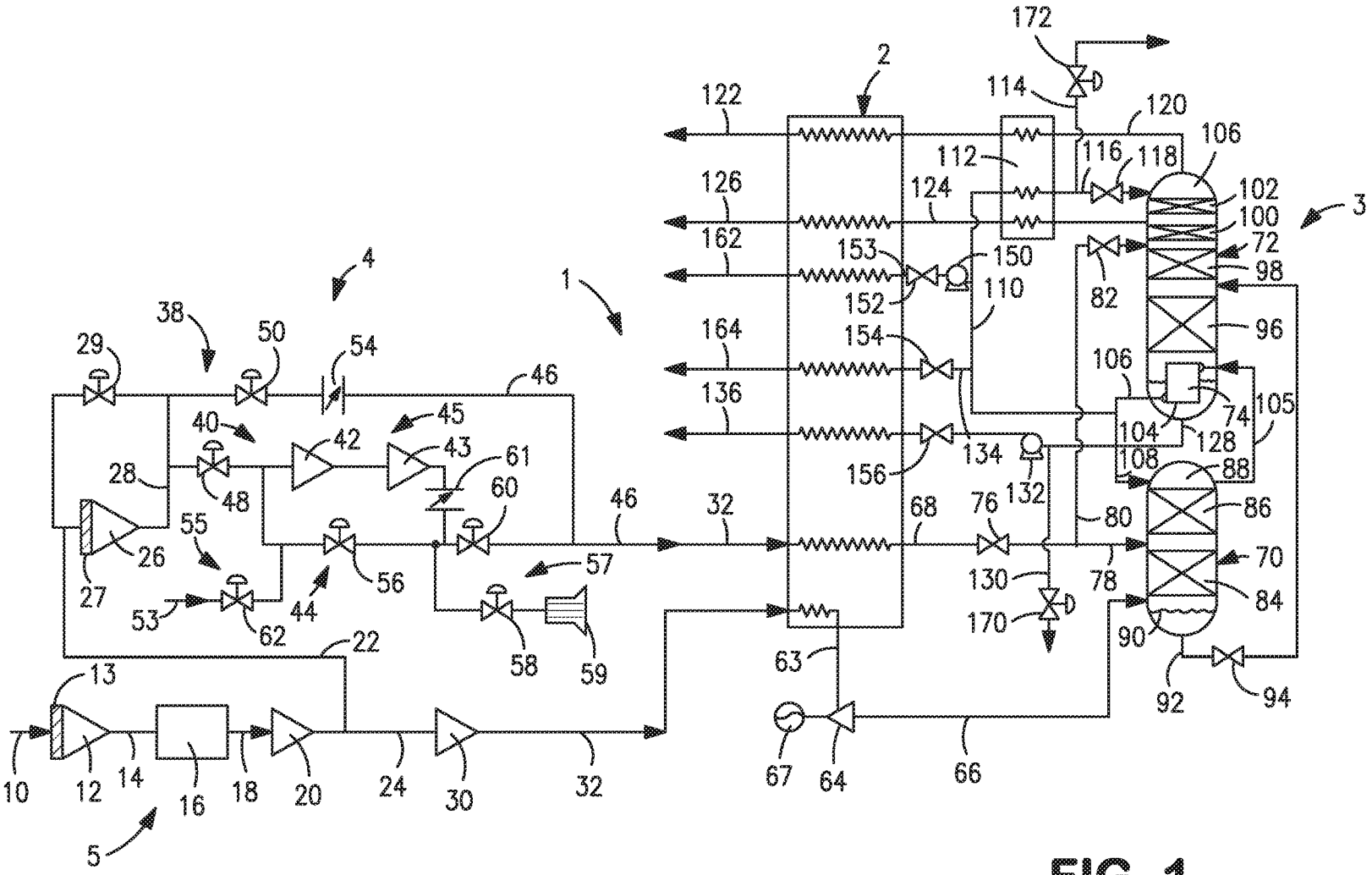
FIG. 1 is a schematic of an air separation plant in accordance with one embodiment of the present invention.
Figure 2:
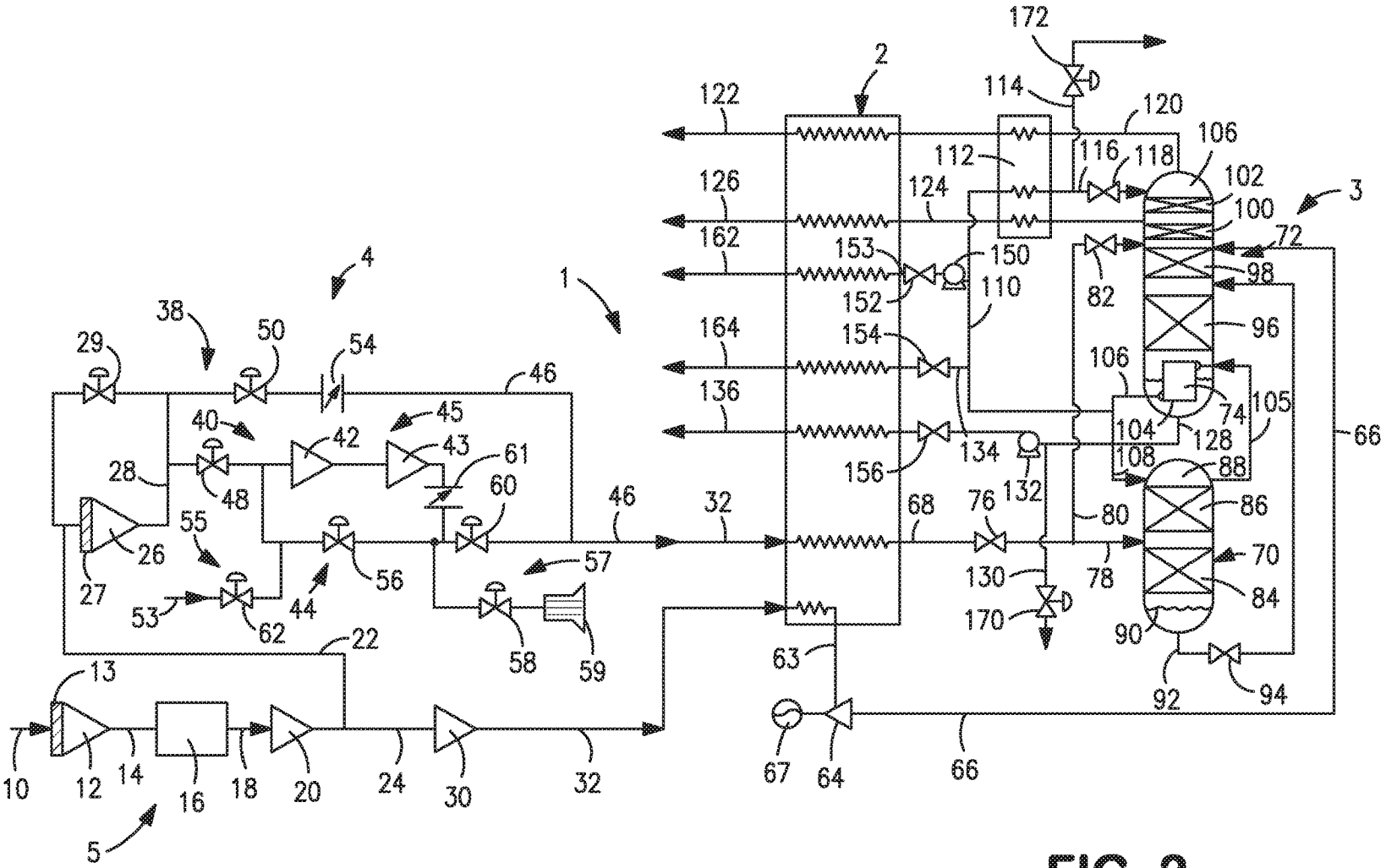
FIG. 2 is a schematic of an air separation plant in accordance with an alternate embodiment the present invention.

With reference to FIG. 1 and FIG. 2, embodiments of an air separation plant 1 in accordance with the present invention are illustrated. As will be discussed, air separation plant 1 is designed to rectify air by compressing and purifying the feed air stream 10 in an air intake system 5, cooling the resulting compressed and purified air within a main heat exchanger 2 and then distilling the air within a distillation column system 3 to produce liquid oxygen and nitrogen product streams 130 and 114, respectively, as well as a pressurized oxygen product stream 136, a gaseous nitrogen product stream 122, and a gaseous waste nitrogen stream 126. Although not shown, the present invention could also be used in connection with an air separation plant designed to additionally produce an argon product that would also be taken as a liquid or other product slates of oxygen and nitrogen. Air separation plant 1 is also provided with a bypass system 4 to produce a compressed output stream of either higher pressure or lower pressure that are used to indirectly heat one or more pressurized liquid streams from the distillation column system and produce the one or more pressurized product streams. The air separation plant 1 is also configured to vary the flow rates and/or pressures of the pressurized liquid streams to in turn vary the production rates and/or pressures of the pressurized products in response to the flows through the bypass system 4.

More specifically, feed air stream 10 is compressed by a main air compressor 12 having inlet guide vanes 13 to produce a compressed air stream 14. Compressed air stream 14 is then introduced into a prepurification unit 16 to produce a compressed and purified air stream 18. As known in the art, the prepurification unit 16 is designed to remove higher boiling impurities from the air such as water vapor, carbon dioxide and hydrocarbons. Such prepurification unit 16 can incorporate adsorbent beds operating in an out of phase cycle that is a temperature swing adsorption cycle or a pressure swing adsorption cycle or combinations thereof.

As seen in FIGS. 1 and 2, the compressed and purified air stream 18 is introduced into a booster compressor 20 and then divided into a first compressed air stream 22 and a second compressed air stream 24. First compressed air stream is further compressed in a booster compressor 26 of the bypass system 4 to form a compressed stream 28 and the second compressed air stream 24 may optionally be further compressed in a booster compressor 30 to form a further compressed air stream 32 for purposes that will be discussed hereinafter.

It is to be noted that various arrangements of booster compressors are possible in accordance with the present embodiments. For instance, an embodiment is possible in which booster compressor 20 is absent. In such case, booster compressor 26 within the bypass system 4 further compresses a first portion of the compressed and purified air stream to produce the compressed stream 28 and a second booster compressor 30 further compresses the second portion of the compressed and purified air stream 18 to produce the further compressed air stream, albeit at a lower pressure than the further compressed air stream 32.

Another possibility or variation of the present embodiments would be to keep booster compressor 20 but remove booster compressor 30. In such case, the entire stream of the compressed and purified air stream 18 would be further compressed in booster compressor 20. A first portion of this further compressed stream would be diverted to the bypass system 4 and still further compressed in booster compressor 26 to form the compressed stream 28. A second portion of the further compressed stream would comprise be the further compressed air stream 32.

In yet another embodiment, booster compressor 26 would not be present and therefore, the compressed and purified air stream 18 would be compressed in booster compressor 20 with the first portion diverted to the bypass system 4 while the second portion would be compressed in booster compressor 30 to form the further compressed air stream 32.

The compressed air stream 28 is then introduced into a branched flow path of the bypass system 4 that has a bypass branch 38 and a booster compressor branch 40. The booster compressor branch 40 is further characterized as having one or more booster compressor stages 42, 43, and a recycle circuit 44, a vent circuit 57, and a low pressure gas supply circuit 55. The branched flow path discharges a compressed output stream 46, composed of the compressed air stream 28 that has a pressure that is dependent upon whether the compressed air stream 28 is introduced into the bypass branch 38 or the booster compressor branch 40.

When the compressed stream 28 is introduced into the booster compressor branch 40, it is further compressed by booster compressor stages 42, 43 to further compress the compressed stream 28 and thereby allow production of the higher pressure compressed output stream 46. Comparatively, when the compressed stream 28 is introduced into the bypass branch 38, the booster compressor stages 42, 43 are bypassed and therefore, the compressed output stream 46 is at a lower pressure that is about equal to that of the incoming compressed stream 28. The bypass branch 38 generally involves less piping and valves which translates to less pressure drop or pressure losses. Within the booster compressor branch 40, a recycle circuit 44 allows a pressure ratio to be maintained across the booster compressor stages 42, 43 independently of any redirection of the compressed air stream 28 between the bypass branch 38 and the booster compressor branch 40 to prevent the booster compressor stages 42, 43 from encountering surge operational conditions.

In a manner that will be discussed in more detail hereinafter, diversion of the compressed air stream 28 between the booster compressor branch 40 and bypass branch 38 is actively controlled by first and second flow control valves 48 and 50, situated in booster compressor branch 40 and bypass branch 38, respectively and passively by check valve 54 located in the bypass branch 38. A third control valve 56 in the recycle circuit 44 actively controls flow of the recycle stream within the recycle circuit 44. Valve 58 in the vent circuit 57 operatively purges flow from the recycle circuit 44 when the pressure exceeds a preset value. Valve 62 disposed in the low pressure gas supply circuit control the introduction of a low pressure gas flow into booster compressor stages 42, 43 as required, particularly during deactivation of the booster compressor stages 42, 43.

The compressed output stream 46 is then fully cooled within the main heat exchanger 2 and condensed to produce a liquid air stream 68 while the heat extracted from the compressed output stream 46 from the bypass system 4 in the illustrated embodiments is preferably used to heat part of an oxygen-rich liquid stream 128 that is pumped to produce a pressurized liquid product stream 136. The liquid air stream 68 is expanded to a pressure of the higher pressure column by means of an expansion valve 76 and divided into first and second subsidiary liquid air streams 78 and 80. The second subsidiary liquid air stream 80 is introduced into the higher pressure distillation column 70 whereas first subsidiary liquid air stream 78 is further expanded by valve 76 and introduced into the lower pressure distillation column 72

In the illustrated embodiments, the second compressed air stream 24 is further compressed in a booster compressor 30 to form a further compressed air stream 32. Further compressed air stream 32 is partially cooled to an intermediate temperature, between temperatures of the warm and cold ends of the main heat exchanger 2 to produce a partially cooled stream 63 that is introduced into an optional turboexpander 64 that generates an exhaust stream 66. Exhaust stream 66 is introduced into the higher pressure distillation column 70 to impart the refrigeration generated by the expansion. The work of expansion generated by turboexpander 64 is dissipated in producing electricity by being coupled to an electric generator 67. The pressure ratio across the turboexpander 64 and therefore, the refrigeration generated thereby will be dependent upon the pressure of the further compressed air stream 32. Depending on the pressure of the exhaust stream, it can be directed to the higher pressure column 70 or lower pressure column 72. FIG. 1 depicts the exhaust stream 66 introduced to the higher pressure column 70 whereas FIG. 2 depicts the exhaust stream 66 introduced to the lower pressure column 72.

As could be appreciated by those skilled in the art, although the further compressed air stream 32 is partially cooled within the main heat exchanger 2, in a possible alternate embodiment of the present invention, the further compressed air stream 32 could bypass the main heat exchanger 2 and be directly introduced into turbo-expander 64, in which case the turbo-expander 64 would be a warm expander and an additional turbo-expander could be provided to impart a base load of refrigeration in or to maintain the air separation plant of such embodiment in heat balance.

The main heat exchanger 2 can be of brazed aluminum construction and although illustrated as a single unit, could be a series of such units operated in parallel. Further, banked instruction is also possible in which the high pressure streams, such as compressed output stream 46 from the bypass section, the further compressed air stream 32 and pumped liquid oxygen stream 134 are subjected to indirect heat exchange within a separate high pressure unit.

Distillation column system 3 has a higher pressure column 70 and a lower pressure column 72 thermally linked in a heat transfer relationship by a condenser reboiler 74 and operating at a lower pressure than the higher pressure column 70. The exhaust stream 66 is introduced into the higher pressure column 70 and the liquid air stream is expanded to a pressure of the higher pressure column by means of an expansion valve 76 and divided into first and second subsidiary liquid air streams 78 and 80. First subsidiary liquid air stream is introduced into the higher pressure column 70 and second subsidiary air stream 80 after expansion in an expansion valve 82 to a pressure of the lower pressure column 72 is introduced into the lower pressure column 72.

Higher pressure column 70 is provided with mass transfer contacting elements 84 and 86, such as structured packing or trays or a combination of packing and trays to contact descending liquid and ascending vapor phases of the air that is introduced into the higher pressure column 70 by means of the first subsidiary liquid air stream 78 and the exhaust stream 66. Due to such contact, as the descending liquid phase will be evermore enriched in oxygen as it descends and the ascending vapor phase will become ever more enriched in nitrogen as it ascends to produce a nitrogen-rich vapor column overhead 88 and a crude liquid oxygen column bottoms 90, also known as kettle liquid. A crude liquid oxygen stream 92 is withdrawn from the higher pressure column 70, valve expanded in expansion valve 94 to the pressure of the lower pressure column 72 and then introduced into the lower pressure column 72 for further refinement. The crude liquid oxygen stream 92 can be subcooled prior to such introduction.

The lower pressure column 72 is also provided with mass transfer contacting elements 96, 98, 100 and 102 to again contact descending liquid and vapor phases to produce an oxygen-enriched liquid column bottoms 104 and a nitrogen-rich vapor column overhead 106. The condenser reboiler 74 partly vaporizes the oxygen-enriched liquid column bottoms 104 through indirect heat exchange with a nitrogen-rich vapor stream 105 composed of the nitrogen-rich vapor column overhead 88 of the higher pressure column 70. The vaporization initiates formation of the ascending vapor phase within the lower pressure column 72 and condenses the nitrogen-rich vapor to produce a nitrogen-rich liquid stream 106. Nitrogen-rich liquid stream 106 is divided into first and second subsidiary nitrogen-rich liquid streams 108 and 110. First subsidiary nitrogen-rich liquid stream 108 is introduced into the top of the higher pressure column 70, as reflux, to initiate formation of the descending liquid phase. During high pressure operating mode, a portion of the second subsidiary nitrogen-rich liquid stream 110 is diverted as a third subsidiary liquid nitrogen stream and pressurized by a pump 150 to produce a pumped liquid nitrogen stream 153. The pumped liquid nitrogen stream 153 is directed via valve 152 to the main heat exchanger 2 where it is fully warmed to produce pressurized nitrogen product stream 162. The un-diverted portion of the second subsidiary nitrogen-rich liquid stream 110 is then sub-cooled in a sub-cooling heat exchanger 112 and optionally divided into a liquid nitrogen product stream 114 and a liquid nitrogen reflux stream 116 that after expansion in valve 118 to a compatible pressure is introduced into the top of the lower pressure column 72 to initiate formation of the descending liquid phase.

A nitrogen-rich vapor stream 120 composed of the nitrogen-rich vapor column overhead 106 is withdrawn from the top of the lower pressure column 72, partly warmed in sub-cooling heat exchanger 112 and then fully warmed in the main heat exchanger to produce a nitrogen product stream 122. Additionally, a waste nitrogen stream 124 can be removed from the lower pressure column 72, at a level below that at which the nitrogen-rich vapor stream 120 is withdrawn, partly warmed in the sub-cooling heat exchanger 112 and then fully warmed in the main heat exchanger 2 to form a warmed waste nitrogen stream 126. The warming of such streams in the sub-cooling heat exchanger 112 provide the indirect heat exchange necessary to sub-cool the second subsidiary nitrogen-rich vapor stream 110. The further warming of such streams in the main heat exchanger 2 help to cool incoming air. The warmed waste nitrogen stream 126 can be used to regenerate adsorbents within adsorbent beds of the pre-purification unit 16.

An oxygen-rich liquid stream 128, composed of residual oxygen-rich liquid column bottoms 104, can be removed from the lower pressure column 72 and then divided into a liquid oxygen product stream 130 and a remaining stream is pressurized by a pump 132 to produce a pumped liquid oxygen stream 134. The pumped liquid oxygen stream 134 is split into two subsidiary liquid oxygen streams which, during high pressure operating mode, are fully warmed in the main heat exchanger 2 to produce pressurized oxygen product streams 136 and 164. The heat exchange for such heating is provided by the high pressure compressed output stream 46. However, during low pressure operating mode, one or both of the valves 154, 156 disposed upstream of the main heat exchanger 2 and associated with the pumped liquid oxygen stream 134 are adjusted to reduce the flow therethrough.

As mentioned above, a system of valves is incorporated into the bypass system 4 to control flow within the branches and circuits within the bypass system 4. While manual control is conceivably possible, the control is preferably automated with the use of a controller (not shown). The controller could be a programmable logic controller obtainable from a variety of sources or could alternatively be incorporated into the plant control system of the air separation plant 1. The control system is typically activated by user input to set the plant into modes of production in which the product slates are produced at prescribed rates and pressures. The control system is preferably designed to control valve operation so that diversion of the compressed air stream 28 between the booster compressor branch 40 and the bypass branch 38 is gradual and with independent control of the recycle stream within the recycle circuit 44 to prevent the booster compressor 42 from entering surge. In addition, the control system governs the flows within the vent circuit 57 to vent gas from the bypass system 4 and the low pressure gas supply circuit 55 to supply a source of low pressure purified purge gas to the booster compressor subsystem 45.

In a high pressure steady state operating mode, a portion of the purified compressed air stream is directed to the booster compressor subsystem 45, schematically depicted within FIGS. 1 and 2. As seen therein, the booster compressor subsystem 45 generally includes booster compressor 42, optional booster compressor 43, optional intercoolers (not shown) and associated valves. In a high pressure steady state operating mode, valve 48 is fully open and valve 50 is closed, thus directing flow of the first compressed air stream 22 through the booster compressor branch 40 of bypass system 4. Check valve 61 and valve 60 are also open while check-valve 54 is closed to ensure the high pressure compressed output stream 46 is directed through the main heat exchanger 2 where it is liquefied into a liquid air stream 68, subsequently expanded in expansion valve 76, and divided into two subsidiary liquid air streams 78 and 80 that are directed to the higher pressure and lower pressure distillation columns 70 and 72, respectively.

In such high pressure steady state mode, valve 29 is configured to prevent booster compressor 26 from a surge condition while valve 56 is configured to prevent compressor stages 42, 43 from surge conditions. Also, valve 62 in the low pressure gas supply circuit and valve 58 in the vent circuit are generally closed as no addition or purging of gases are contemplated in such steady state operation. Of course, in conditions where the reduction of pressure or the purging of gas is required, the control unit would activate valve 62 and/or valve 58 as required.

In a low pressure steady state operating mode, a portion of the purified compressed air stream is directed to bypass much of the booster compressor subsystem 45. During the low pressure steady state operating mode, valve 48 is closed and valve 50 is open, thus directing flow of the first compressed air stream 22 through only booster compressor 26 and then via the bypass branch 38 of the bypass system 4. Check valve 61 and valve 60 are also closed to ensure the lower pressure compressed output stream 46 is directed through the main heat exchanger 2 where it is liquefied into a liquid air stream 68, subsequently expanded in expansion valve 76, and divided into two subsidiary liquid air streams 78 and 80. Liquid air stream 78 is directed to the higher pressure distillation column 70 while liquid air stream 80 is further expanded in valve 82 and directed to the lower pressure distillation column 72.

In such low pressure steady state mode, valve 29 is again configured to prevent booster compressor 26 from a surge condition while valve G62 in the low pressure gas supply circuit, valve 56 in the recycle conduit, and valve 58 in the vent circuit are generally open to keep compressor stages 42, 43 rotating while also preventing vacuum or surge conditions in compressor stages 42, 43.

When the air separation plant is to be switched or transitioned from a low pressure operation mode to a high pressure operation mode, the control system takes action to alter the flows in the bypass system 4 as well as to control selected flows to the main heat exchanger 2. Controlling the bypass system 4 involves gradually opening flow control valve 48 while gradually closing control valve 50 within the bypass branch 38 to gradually divert the compressed air stream 28 from the bypass branch 38 to the booster compressor branch 40. Preferably, any purge stream of low pressure purified air directed through the booster compressor 42 during low pressure operation mode should be discontinued. In order to end or discontinue the purge stream, valve 58 in the vent conduit is set to the closed position and a check valve (not shown) in the low pressure gas supply conduit closes under the increased pressure realized within the booster compressor branch 40. Thereafter, a valve 62 in the low pressure gas supply conduit is set to the closed position such that any flow through the compressor stages 42, 43 originates from the purified, compressed incoming air stream.

When the pressure within the booster compressor branch 40, exceeds the pressure within the bypass branch 38, check valve 54 closes to prevent the flow from reversing in the booster compressor branch 40 while at the same time, check valve 61 and valve 60 open. At this point, flow control valve 50 can preferably be set in a closed position and valve 56 in the recycle circuit 44 will begin to close as the flow through compressor stages 42, 43 increases. Control valve 56 moves to close as far as possible while preventing compressor stages 42, 43 from surging. Positioning of the inlet guide vanes 27 controls the discharge pressure on the compressor stages 42, 43.

Control of selected product flows to the main heat exchanger is effected concurrently with the control of the bypass system 4. Specifically, control of the product flows to the main heat exchanger 2 is effected by simply further opening valves 152, 154, 156 and raising the pressure on streams 162, 164, 136, and hence the product pressures. Optionally, pumps 132 and pump 150 may be accelerated if required.

Conversely, when the air separation plant is to be switched or transitioned from a high pressure operation mode to a low pressure operation mode, the control system takes action to alter the flows in the bypass system 4 as well as to alter flows to the main heat exchanger 2. Specifically, control of the main heat exchanger 2 is effected by adjusting either or both valve 154 and valve 156 to lower the liquid oxygen production. Optionally, pump 132 may be slowed to also conserve energy and lower the liquid oxygen pressures. Valve 152 is adjusted to reduce liquid nitrogen pressure and pump 150 may also be slowed to further reduce energy use within the air separation plant.

Control of the bypass system 4 is effected during transitioned from a high pressure operation mode to a low pressure operation mode by unloading the booster compressor subsystem 45 and particularly, compressor sections 42 and 43. To achieve this unloading in a safe and reliable manner, the compressed air stream 28 is gradually diverted from the booster compressor branch 40 of the bypass system 4 to the bypass branch 38. To such end, control valve 50 is gradually opened to gradually increase flow of the compressed air stream 28 into the bypass branch 38. At the same time, flow control valve 48 gradually closes to gradually decrease the flow of the compressed air stream 28 within the booster compressor branch 44. Concurrently, valve 56 is opened to a preset value or position to prevent surging of compressor stages 42, 43. Once the pressure in the bypass branch 38 exceeds the pressure in the booster compressor branch 40, check valve 54 opens, control valve 48 closes, and booster compressor stages 42, 43 are deactivated. The term "deactivated" as used herein and in the claims encompasses either an operation in which booster compressor stages 42, 43 are turned off or are set in a low pressure mode of operation. In the low pressure mode of operation the power is reduced and the compressors operate at a very low inlet pressure and at a reduced mass flow rate. In addition to recycle flow through the recycle conduit 44, the low pressure mode of operation would require suitable adjustment of inlet guide vanes 27.

At this point, the purge air stream 53 is introduced via the low pressure gas supply conduit 55 to booster compressor stages 42, 43 to prevent the entry of untreated air into the bypass system 4. The problem with ambient air entry into the booster compressor stages 42, 43 is that the ambient air has not been purified of the higher boiling contaminants; and without such purification, the higher boiling contaminants could enter the main heat exchanger 2 or the distillation column 3 and solidify causing potential safety hazards. The purge air stream 53 is preferably comprised of purified air and may be obtained from a bleed stream from an operating compressor that is also used in supplying instrument air to air separation plant. In this regard, as known in the art, booster compressor stages 42, 43 can be provided with labyrinth seals that surround the outer portion of the compressor impellers to prevent high pressure air from escaping from such region. In such an arrangement, a balance of forces acting on the impeller of the compressor is obtained by balancing compressor forces at the inlet of the compressor and forces acting at the back side of the impeller. The forces on the back side of the impeller are produced by high pressure compressed air acting at an outer, annular region of the impeller, outbound of the labyrinth seals, and at an inner circular region of the back side of the impeller, inbound of the labyrinth seals, by providing air from the inlet of the compressor to such inner region of the impeller. Assuming that the booster compressor stages 42, 43 when deactivated, are operated in the low pressure mode, the pressure at the inlet of the booster compressor 42 will be low, typically about 5 psia. When first flow control valve 48 is set in a fully closed position, a check valve opens due to such low pressure and the slightly higher pressure of the instrument air. At this point, valve 62 is set in an open position. Thereafter, valve 58 in the vent circuit 57 is also is commanded into an open position to reduce pressure within the loop. Valve 58 closes when pressure in the loop reaches a pre-set low value. The purge air stream simply escapes from the labyrinth seals to the interior of the compressor and through the volute to the outlet of the compressor to prevent ambient air from entering the booster compressor stages 42, 43. In lieu of such an operation, it also is possible for the purge air stream to simply escape from the outlet of the compressors and be discharged through valve 58 and vent 59.

While the present invention has been characterized in various ways and described in relation to preferred embodiments, as will occur to those skilled in the art, numerous, additions, changes and modifications thereto can be made without departing from the spirit and scope of the present invention as set forth in the appended claims.

What is claimed is:

1. An air separation system comprising:

an air intake system comprising a main air compressor, a purification unit connected to the main air compressor, the air intake system configured to produce a stream of compressed, purified air;

a bypass system in flow communication with the air intake system and configured to receive a first portion of the compressed, purified air stream and condition the first portion of the compressed, purified air stream into a compressed output stream; the bypass system comprising a booster compressor circuit having one or more booster compressors, a bypass circuit, and a plurality of control valves to control the flows through the booster compressor circuit and the bypass circuit;

a main heat exchanger in flow communication with the air intake system and the bypass system, the main heat exchanger configured to receive the conditioned compressed output stream from the bypass system and indirectly heat one or more pressurized liquid streams with the compressed output stream;

the main heat exchanger further configured to receive a second portion of the compressed, purified air stream from the air intake system and partially cool the second portion of compressed, purified air to a temperature that is between the temperature of the warm end of the main heat exchanger and a temperature of the cold end of the main heat exchanger;

a distillation column system comprising a higher pressure column and a lower pressure column connected to the main heat exchanger and configured to rectify the cooled, compressed output stream and thereby to produce the one or more pressurized liquid streams;

a turbo-expander in flow communication with the main heat exchanger and configured to receive and expand the partially cooled second portion of the compressed, purified air stream to produce power and an exhaust stream, the turbo-expander further connected to the distillation column system so that the exhaust stream is introduced into the distillation column system to impart refrigeration to the air separation plant; and a controller operatively coupled to at least the bypass system to control the plurality of control valves to selectively introduce the first portion of the compressed, purified air stream into either the booster compressor circuit and thereby produce a higher pressure compressed output stream or the bypass circuit to produce a lower pressure compressed output stream;

wherein the bypass system is configured to prevent the one or more booster compressors from surge conditions during production of the higher pressure compressed output stream and to maintain a purge stream in the booster compressor circuit during production of the lower pressure compressed output stream;

wherein the controller is further configured to gradually divert some of the further compressed portion of the compressed, purified air from the bypass circuit to the one or more booster compressors in the booster compressor circuit when shifting from production of the compressed output stream at the lower pressure to production of the compressed output stream at the higher pressure; and wherein the controller is still further configured to gradually divert some of the further compressed portion of the compressed, purified air from the one or more booster compressors in the booster compressor circuit to the bypass circuit when shifting from production of the compressed output stream at the higher pressure to production of the compressed output stream at the lower pressure.

2. The air separation system of claim 1 wherein the plurality of control valves further comprise a recycle control valve operatively associated with the recycle circuit, and wherein the controller is configured to control the recycle control valve to circulating a recycle stream flowing within a recycle circuit from an outlet of the one or more booster compressors in the booster compressor circuit to an inlet of the one or more booster compressors.

3. The air separation of claim 1 wherein the plurality of control valves further comprise a purge control valve operatively associated with a low pressure gas supply conduit, and wherein the controller is configured to control the purge control valve to supply a purge stream of a purified, low pressure gas via the low pressure gas supply conduit to the one or more booster compressors in the booster compressor circuit when the one or more booster compressors in the booster compressor circuit are deactivated.

4. The air separation of claim 1 wherein the exhaust stream is introduced into the higher pressure column of the distillation column system to impart refrigeration to the air separation plant.

5. The air separation system of claim 1 wherein the exhaust stream is introduced into the lower pressure column of the distillation column system to impart refrigeration to the air separation plant.

6. The air separation system of claim 1 wherein the booster compressor circuit is coupled to the warm end of the main heat exchanger such that the higher pressure compressed output stream is directed to the warm end of the main heat exchanger.

7. The air separation system of claim 1 wherein the bypass circuit is coupled to the warm end of the main heat exchanger such that the lower pressure compressed output stream is directed to the warm end of the main heat exchanger.

* * * * *